US008814812B2

(12) United States Patent
Armstrong

(10) Patent No.: US 8,814,812 B2
(45) **Date of Patent: *Aug. 26, 2014**

(54) RECIPROCATING BRACE

(75) Inventor: Ned B. Armstrong, Alpharetta, GA (US)

(73) Assignee: M.A.R.B. Rehab International, Inc., Dacula, GA (US)

( * ) Notice: Subject to any disclaimer, the term of this patent is extended or adjusted under 35 U.S.C. 154(b) by 1480 days.

This patent is subject to a terminal disclaimer.

(21) Appl. No.: 12/020,239

(22) Filed: Jan. 25, 2008

(65) Prior Publication Data

US 2009/0192420 A1 Jul. 30, 2009

(51) Int. Cl.
*A61H 1/00* (2006.01)

(52) U.S. Cl.
USPC ..... 601/40; 601/5; 602/22; 482/47

(58) Field of Classification Search
USPC ..... 601/5, 23, 33, 40, 84, 97, 98; 602/5, 12, 602/16, 20–22; 128/846, 869, 878–880; 2/16–21; 401/7; 482/44–49, 124; 606/55
See application file for complete search history.

(56) References Cited

U.S. PATENT DOCUMENTS

| | | | | | |
|---|---|---|---|---|---|
| 494,197 | A | * | 3/1893 | Hall | 482/48 |
| 1,907,529 | A | | 5/1933 | Faure-Roux | |
| 2,022,883 | A | * | 12/1935 | Gee | 602/5 |
| 3,809,600 | A | * | 5/1974 | Larson | 428/131 |
| 4,142,852 | A | | 3/1979 | Schuierer | |
| 4,602,620 | A | | 7/1986 | Marx | |
| 4,875,469 | A | * | 10/1989 | Brook et al. | 601/40 |
| 4,949,711 | A | * | 8/1990 | Gyovai et al. | 602/21 |
| 5,348,531 | A | | 9/1994 | Brown et al. | |
| 5,413,554 | A | * | 5/1995 | Trueman | 602/21 |
| 1,736,930 | A | | 9/1995 | Fula et al. | |
| 5,469,652 | A | * | 11/1995 | Drosdak | 43/44.83 |
| 5,527,040 | A | * | 6/1996 | Stanley et al. | 473/213 |
| 5,820,577 | A | * | 10/1998 | Taylor | 601/40 |
| 5,921,945 | A | | 7/1999 | Gray | |
| 6,063,087 | A | | 5/2000 | Agee et al. | |
| 6,293,918 | B1 | | 9/2001 | Wang | |
| 7,001,352 | B2 | * | 2/2006 | Farrell et al. | 602/21 |
| 7,156,819 | B2 | | 1/2007 | Sieller et al. | |
| 2006/0211964 | A1 | | 9/2006 | Farrell et al. | |
| 2010/0130895 | A1 | | 5/2010 | Armstrong et al. | |

OTHER PUBLICATIONS

International Search Report for International Application No. PCT/US2009/00494 (mailed Mar. 10, 2009).
Office Action from related U.S. Appl. No. 12/634,770 (Sep. 20, 2011).
Application and File History of U.S. Appl. No. 12/634,770, Inventors Armstrong et al., filed Dec. 10, 2009.

* cited by examiner

*Primary Examiner* — Quang D Thanh
(74) *Attorney, Agent, or Firm* — Patterson Thuente Pedersen, P.A.

(57) ABSTRACT

An apparatus for passive contraction of at least one finger of a patient with an upper arm unit, a lower arm unit, and at least one connective line. The apparatus is configured such that elbow extension of the patient promotes finger flexion. This is accomplished by taking advantage of the geometry of the arm, where the distance from a point on the patient's humeral area to the patient's fingers is greater when the patient's arm is in extension than when it is in flexion. In one aspect, the upper arm unit is configured to connect to a portion of the patient's arm between the patient's elbow and shoulder and the lower arm unit is configured to connect to a portion of the patient's arm intermediate the patient's hand and elbow.

20 Claims, 3 Drawing Sheets

RECIPROCATING BRACE

FIELD OF THE INVENTION

This invention relates to a reciprocating brace and, more particularly, to a reciprocating brace for passive finger joint motion.

BACKGROUND OF THE INVENTION

Often times post surgical rehabilitation programs to overcome restrictive flexor and extensor tendinorrhaphy site fibrous adhesions require finger joint motion. Patient apprehension, pain, and stress to the tendon repair sites often interferes with immediate post-operative voluntary contraction of the involved tendon muscles. Current rehabilitation strategies delay the motion of the fingers for this reason. However, this delay advances potentially debilitating fibrous adhesions and joint contractures.

Early motion of the finger joints can reduce joint stiffness to avoid or treat reflex sympathetic dystrophies. It can also reduce the adhesions from reactive synovitis associated with both rheumatoic and non-rheumatoid arthritic patients and enhance post operative rehabilitation following finger joint replacements. In all these examples, combating expected early peri-tendinorrhaphy scarring, secondary joint stiffness from primary soft tissue and intrinsic muscle contractures will potentially avoid subsequent surgery to remedy these issues.

Therefore, what is needed is an apparatus to assist in post operative rehabililitation that assists in passive flexion and contraction of finger joints that is easy to use and inexpensive to manufacture.

SUMMARY

The invention relates to a therapy apparatus for passive contraction of at least one finger of a patient. The therapy apparatus comprises an upper arm unit, a lower arm unit, and at least one connective line. The apparatus is configured such that elbow extension of the patient promotes finger flexion. This is accomplished by taking advantage of the geometry of the arm, where the distance from a point on the patient's humeral area to the patient's fingers is greater when the patient's arm is in extension than when it is in flexion.

In one aspect, the upper arm unit is configured to connect to a portion of the patient's arm between the patient's elbow and shoulder. In another aspect, the lower arm unit is configured to connect to a portion of the patient's arm intermediate the patient's hand and elbow. The upper and lower arm units may, in one aspect, comprise polychloroprene or similar substance. It is also contemplated that the upper and lower arm units comprise sections of one contiguous arm unit.

DETAILED DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
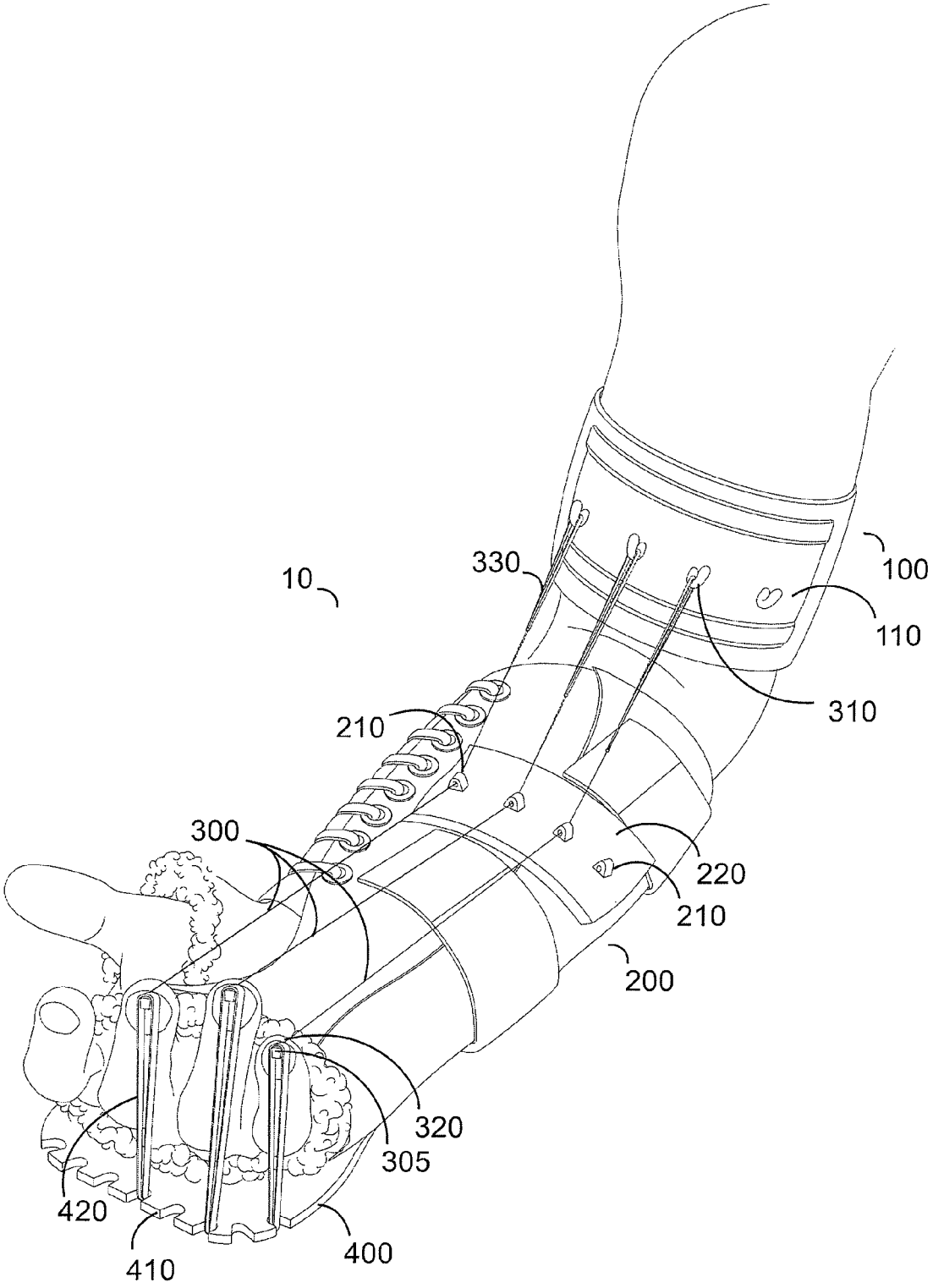
FIG. 1 is a top perspective view of one embodiment of a therapy apparatus according to the present invention.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a needle" can include two or more such needles unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The invention relates to a therapy apparatus 10 for passive contraction of at least one finger of a patient. The therapy apparatus 10 comprises an upper arm unit 100, a lower arm unit 200, and at least one connective line 300. The apparatus is configured such that elbow extension of the patient promotes finger flexion. This is accomplished by taking advantage of the geometry of the arm, where the distance from a point on the patient's humeral area to the patient's fingers is greater when the patient's arm is in extension than when it is in flexion.

In one aspect, the upper arm unit 100 is configured to connect to a portion of the patient's arm between the patient's elbow and shoulder. For example and not meant to be limiting, the upper arm unit may substantially wrap around the patient's upper arm in substantially the same manner as a blood pressure cuff. However, it should be noted that one skilled in the art may connect the upper arm unit to the patient's upper arm in a variety of ways.

In another aspect, the lower arm unit 200 is configured to connect to a portion of the patient's arm intermediate the patient's hand and elbow. For example, the lower arm unit may be connected to the arm on or substantially adjacent a forearm region. It may also be connected to the arm on or substantially adjacent a wrist. The lower arm unit may be connected in substantially the same manner as a blood pressure cuff, however, it may also be connected in various other manners. In yet another aspect, as illustrated in FIG. 1, the lower arm unit not only connects to the lower portion of the patient's arm, but it also connects to a portion of the patient's hand. The upper and lower arm units 100, 200 may, in one aspect, comprise polychloroprene or similar substance. It is also contemplated that the upper and lower arm units comprise sections of one contiguous arm unit.

Regardless of how it is connected to the arm, in one aspect, the lower arm unit comprises at least one aperture 210 defined therein. Additionally, the therapy apparatus comprises at least one connective line 300, connected to a portion of the upper arm unit at one end and selectively connected to a portion of the finger on the patient's hand at the other end. In one example, the connective line is connected to a distal portion of the finger. The finger may, for example, comprise a finger hook 305 to enable easy connection thereto for the connective line. In another aspect, the connective line also passes therethrough the at least one aperture 210.

As a result of the placement of the connective line 300 from the upper arm unit 100, through the aperture on the lower arm unit 200, to the finger, when the patient's arm is extended, the distance between the upper arm unit and the patient's affected finger increases, putting tension on the connective line and resulting in flexion of the effected finger. It should be noted that the apparatus may comprise a plurality of connective lines with a plurality of corresponding apertures. In one aspect, each connective line is connected thereto a separate finger on the patient's hand.

In one aspect, the aperture on the lower arm unit is raised therefrom the exterior surface of the lower arm unit. For example, as illustrated in FIG. 1, the aperture 210 may extend above the surface of the lower arm unit much like an eyelet, where the connective line 300 is threaded therethrough. In another aspect, the aperture is defined on a lower arm unit attachment 220 which is removably attachable to the lower arm unit 200, such that the position of the aperture is adjustable in order to achieve a desired finger pull direction. In one exemplary aspect, the lower arm unit attachment 220 is attachable to the lower arm unit using hook and loop fasteners. However, as one skilled in the art can appreciate, any removable attachment means are contemplated. In yet another aspect, there may be a plurality of lower arm unit attachments, each equipped with apertures to guide the direction of the connective line.

In another exemplary aspect, similar to the aspect of the lower arm unit mentioned herein above, the upper arm unit may also comprise an upper arm unit attachment 110 that is removably attachable to a portion of the upper arm unit 100. In this aspect, the proximal end 310 of the connective line is attached thereto a portion of the upper arm unit via the upper arm unit attachment 110. In another aspect, the distal end 320 of the connective line is attached thereto a portion of the finger on the patient's hand. The upper arm unit attachment may be attachable to the upper arm unit using hook and loop fasteners. However, as one skilled in the art can appreciate, any removable attachment means are contemplated.

The connective line, for example and not meant to be limiting, may comprise a bias element 330. FIG. 1 shows a bias element 330 positioned substantially near the proximal end 310 of the connective line. In another aspect, the bias element comprises a rubber band. In yet another aspect, the connective line comprises a monofilament polymer thread.

The therapy apparatus 10 may also comprise a dorsal unit 400 configured to connect to a portion of the patient's arm substantially opposing the lower arm unit and substantially extending along a dorsal side of the patient's hand. In this aspect, a portion of the dorsal unit 400 is configured to attach to a portion of the finger on the patient's hand to resist flexion of the finger. In this manner, when the arm is in flexion, the finger will tend to stay in extension.

Figure 2:
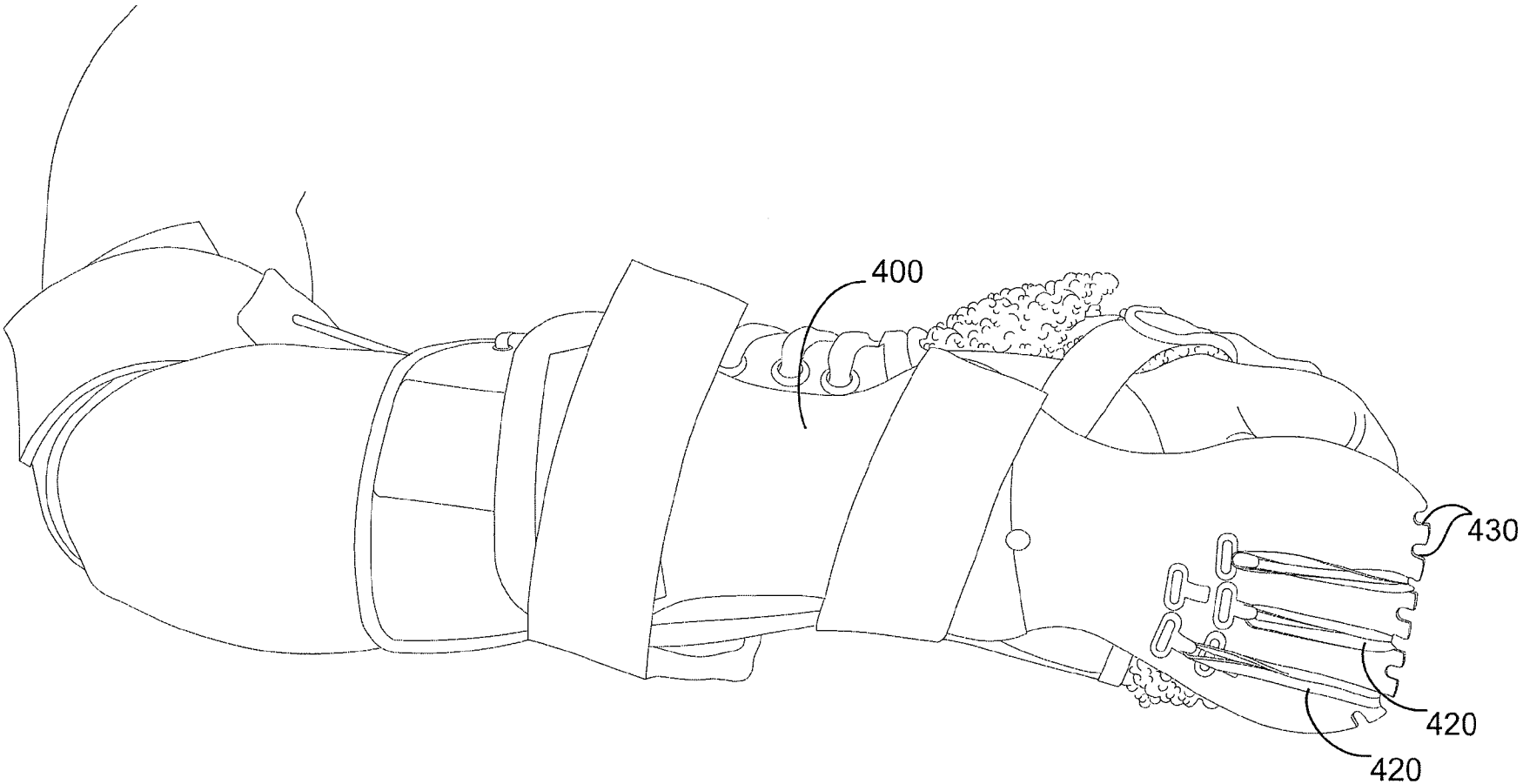
FIG. 2 is bottom perspective view of the therapy apparatus of FIG. 1, showing a substantially elastic dorsal line extending therefrom a distal portion of a dorsal unit.
Figure 3:
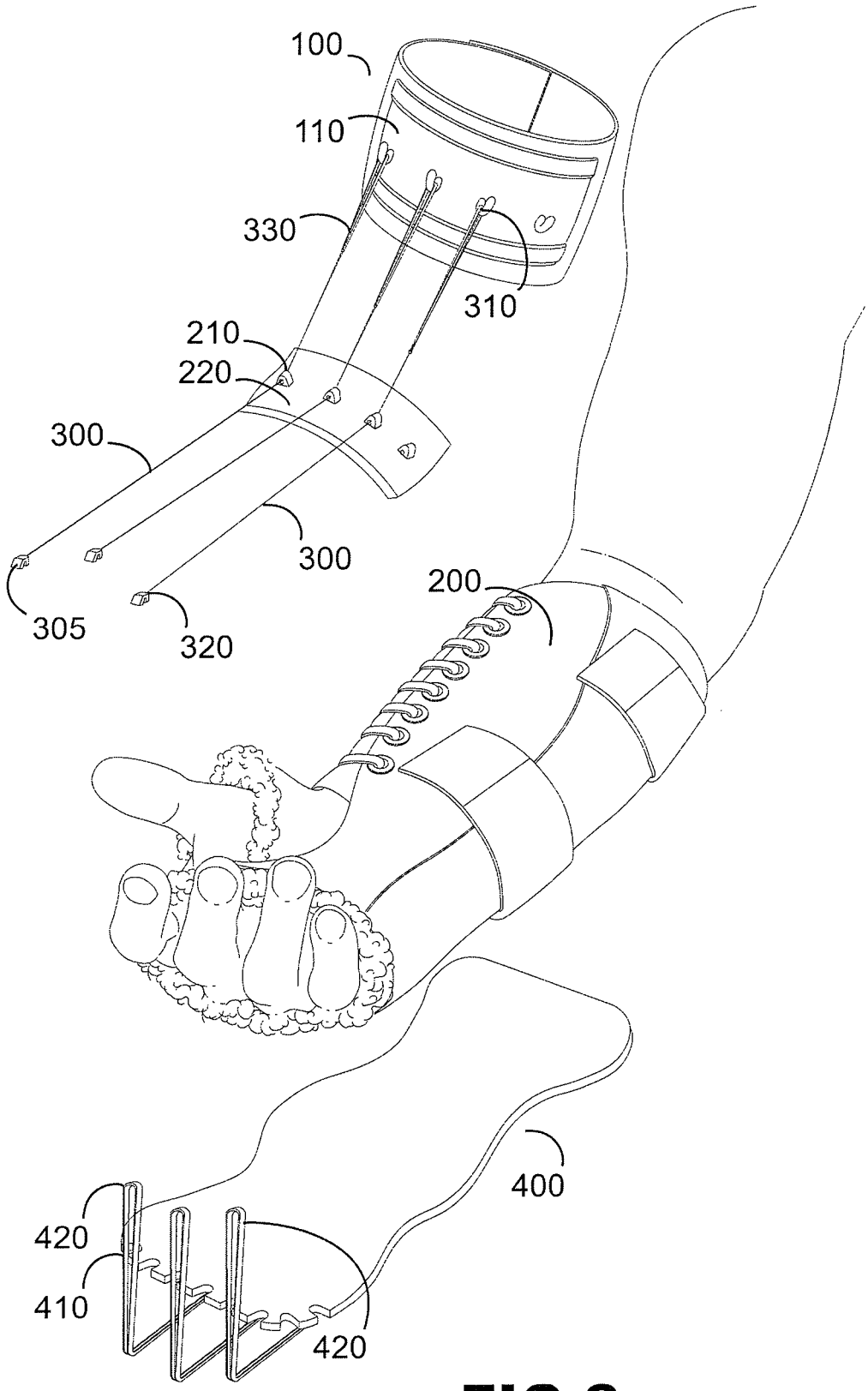
FIG. 3 is a partially exploded top perspective view of the therapy apparatus of FIG. 1, showing an upper arm unit, a lower arm unit, and a dorsal unit.

In one exemplary aspect, a distal portion 410 of the dorsal unit extends to about a distal interphalangeal joint of at least one of the patient's fingers. It may have at least one substantially elastic dorsal line 420 extending from the distal portion of the dorsal unit and connected to a portion to of the finger on the patient's hand. In order to position the dorsal line 420 at a desired location with respect to the finger, the distal end of the dorsal unit may be equipped with a plurality of spaced grooves 430, as shown in FIG. 2. Of course, there may be a separate dorsal line for each finger. In an effort to distance the distal end portion of the dorsal unit 400 from the patient's finger and to provide resistance for the dorsal line when it is in tension, in one aspect, at least a portion of the dorsal unit is substantially rigid.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

The invention claimed is:

1. A therapy apparatus for passive contraction of at least one finger of a patient, comprising:

an upper arm unit configured to connect to a portion of the patient's arm between the patient's elbow and shoulder;

a lower arm unit configured to connect to a portion of the patient's arm intermediate the patient's hand and elbow, the lower arm unit comprising at least one aperture defined therein a portion of the lower arm unit, wherein the at least one aperture is proximate an anterior forearm region of the patient;

at least one connective line having a proximal end selectively connected thereto a portion of the upper arm unit and a distal end configured to selectively connect to a portion of the at least one finger on the patient's hand, wherein the at least one connective line also passes therethrough the at least one aperture, the at least one connective line longitudinally proximate both the anterior forearm region and an anterior upper arm region of the patient;

a dorsal unit configured to connect to a portion of the patient's arm substantially opposing the lower arm unit and substantially extending along a dorsal side of the patient's hand, wherein a portion of the dorsal unit is configured to attach to a portion of the finger on the patient's hand to resist flexion of the finger;

a distal portion of the dorsal unit extends to about a distal interphalangeal joint of at least one of the patient's fingers;

at least one substantially elastic dorsal line extending therefrom the distal portion of the dorsal unit and configured to connect to a portion of the finger on the patient's hand;

wherein the distal portion of the dorsal unit comprises a plurality of spaced grooves configured to position the at least one dorsal line at a desired location with respect to the finger on the patient's hand; and wherein the distal end of the at least one connective line is spaced a first distance from the portion of the upper arm unit when the patient's arm, hand, and fingers are in a fully extended anatomical position and wherein the at least one connective line has a length that is less than the first distance when the patient's arm is in a partially extended anatomical position, whereby dynamic extension of the patient's arm causes tension in the at least one connective line which causes the at least one finger to passively contract inwardly toward the at least one aperture in the lower arm unit.

2. The therapy apparatus of claim 1, wherein the at least one aperture is raised therefrom an exterior surface of the lower arm unit.

3. The therapy apparatus of claim 2, wherein the at least one aperture is defined therein a lower arm unit attachment, wherein the lower arm unit attachment is removably attachable to the lower arm unit such that the position of the at least one aperture is adjustable in order to achieve a desired finger pull direction.

4. The therapy apparatus of claim 1, wherein the upper arm unit comprises an upper arm unit attachment that is removably attachable to a portion of the upper arm unit and wherein the proximal end of the connective line is attached thereto a portion of the upper arm unit via the upper arm unit attachment.

5. The therapy apparatus of claim 1, wherein the at least one connective line comprises a bias element.

6. The therapy apparatus of claim 5, wherein the bias element is positioned substantially near the proximal end of the connective line.

7. The therapy apparatus of claim 5, wherein the bias element comprises a rubber band.

8. The therapy apparatus of claim 1, wherein the at least one connective line comprises a monofilament polymer thread.

9. The therapy apparatus of claim 3, wherein the lower arm unit attachment is attached to the lower arm unit via hook and loop fasteners.

10. The therapy apparatus of claim 1, wherein the lower arm unit is configured to connect to the arm on or substantially adjacent a forearm region.

11. The therapy apparatus of claim 1, wherein the lower arm unit is configured to connect to the arm on or substantially adjacent a wrist.

12. The therapy apparatus of claim 1, wherein the upper arm unit comprises polychloroprene.

13. The therapy apparatus of claim 1, wherein the lower arm unit comprises polychloroprene.

14. The therapy apparatus of claim 1, wherein the distal end of the at least one connective line is configured to selectively connected to a distal end portion of the finger on the patient's hand such that a pivoting of the patient's elbow causes the at least one finger to contract inwardly toward the at least one aperture in the lower arm unit.

15. The therapy apparatus of claim 1, which comprises a plurality of connective lines.

16. The therapy apparatus of claim 13, wherein the lower arm unit comprises a plurality of apertures defined therein the portion of the lower arm unit.

17. The therapy apparatus of claim 1, further comprising a finger hook attached to the finger, wherein the connective line is selectively attached to the finger hook.

18. The therapy apparatus of claim 1, wherein the upper and lower arm units are cuffs, each cuff is configured to substantially surround the respective portion of the patient's arm.

19. The therapy apparatus of claim 1, wherein the upper and lower arm units comprise one contiguous arm unit.

20. The therapy apparatus of claim 1, wherein at least a portion of the dorsal unit is substantially rigid.

* * * * *